US005512040A

United States Patent [19]

Mathews

[11] Patent Number: 5,512,040

[45] Date of Patent: Apr. 30, 1996

[54] SPINAL TRACTION DEVICE

[76] Inventor: Paul K. Mathews, 3730 Price Rd. NE., Newark, Ohio 43055

[21] Appl. No.: 299,265

[22] Filed: Sep. 1, 1994

[51] Int. Cl.[6] ..... A61H 1/02

[52] U.S. Cl. ..... 602/36; 602/33; 601/24; 606/241

[58] Field of Search ..... 602/32, 33, 35, 602/36; 601/24, 90, 98; 606/241, 242; 482/131, 907

[56] References Cited

U.S. PATENT DOCUMENTS

| | | | |
|---|---|---|---|
| 2,822,805 | 2/1958 | Hill | 606/242 |
| 4,579,109 | 4/1986 | Lundblad | 606/242 |

FOREIGN PATENT DOCUMENTS

| | | | |
|---|---|---|---|
| 2290184 | 6/1976 | France | 602/33 |

*Primary Examiner*—Richard J. Apley

*Assistant Examiner*—Jeanne M. Clark

[57] ABSTRACT

A spinal traction device comprising a bench for supporting a user; a first tensioning arm having a base end, a tip end, and a location therebetween pivotally coupled to one end of the bench with the tip end extending upwards above the bench and with the base end extended downwards; a second tensioning arm having base end, a tip end, and a location therebetween pivotally coupled to the other end of the bench with the tip end extending upwards and with the base end extended downwards; a third tensioning arm having a base end, a tip end, and a location therebetween pivotally coupled to the bench below the first tensioning arm with tip end extended upwards and with the base end extended downwards; rod mean device secured between the base end of the first tensioning arm and the base end of the second tensioning arm and secured between the tip end of the second tensioning arm and the base end of the third tensioning arm; an upper belt secured to the first tensioning arm and securable about user laying upon the bench; and a lower belt secured to the second tensioning arm and securable about a user laying upon the bench.

5 Claims, 4 Drawing Sheets

SPINAL TRACTION DEVICE

BACKGROUND OF THE INVENTION

1. Field of the Invention

The present invention relates to a spinal traction device and more particularly pertains to allowing a user to stretch his spine using controlled tension for alleviating pain in pinched spinal nerves with a spinal traction device.

2. Description of the Prior Art

The use of traction devices is known in the prior art. More specifically, traction devices heretofore devised and utilized for the purpose of alleviating pain in nerves of the spine are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,602,619 to Wolf et al. discloses a method and device for producing variable spinal traction. U.S. Pat. No. 5,010,880 to Lamb discloses a home traction device. U.S. Pat. No. 5,031,898 to Anthony discloses an ambulatory lumbar traction device. U.S. Pat. No. 5,135,537 to Lamb discloses a home traction device. U.S. Pat. No. 5,258,017 to Myers et al. discloses a traction device.

While these devices fulfill their respective, particular objective and requirements, the aforementioned patents do not describe a spinal traction device that allows a user to provide controlled tension to stretch his spine for alleviating pain without the need of assistance from another person.

In this respect, the spinal traction device according to the present invention substantially departs from the conventional concepts and designs of the prior art, and in doing so provides an apparatus primarily developed for the purpose of allowing a user to stretch his spine using controlled tension for alleviating pain in pinched spinal nerves.

Therefore, it can be appreciated that there exists a continuing need for new and improved spinal traction device which can be used for allowing a user to stretch his spine using controlled tension for alleviating pain in pinched spinal nerves. In this regard, the present invention substantially fulfills this need.

SUMMARY OF THE INVENTION

In the view of the foregoing disadvantages inherent in the known types of traction devices now present in the prior art, the present invention provides an improved spinal traction device. As such, the general purpose of the present invention, which will be described subsequently in greater detail, is to provide a new and improved spinal traction device and method which has all the advantages of the prior art and none of the disadvantages.

To attain this, the present invention essentially comprises, in combination, a rigid bench adapted for supporting a user laying thereupon. The bench has a rectangular planar horizontal top with a periphery formed of a short front edge, a short rear edge, and two opposed long side edges, a front pair of legs with each leg coupled to a separate corner of the top near the front edge and extended downwards therefrom to terminate at a free end, a rear pair of legs with each leg coupled to a separate corner of the top near the rear edge and extended downwards therefrom to terminate at a free end, two opposed elongated horizontally aligned cross legs each coupled between a separate front leg and a separate rear leg at a location offset upwards from the free ends thereof, and a rectangular mattress pad secured upon the top. A first tensioning arm is included and has a horizontal elongated rigid first shaft pivotally coupled to the bench between the front pair of legs, a pair of rigid exterior tongues with each exterior tongue having a base end coupled to a separate end of the first shaft and a tip end extended angularly upwards toward the bench to a location above the mattress pad, a horizontal elongated rigid weight bar coupled to the tip ends of the exterior tongues and extended outwards therefrom, and a rigid interior tongue having a base end coupled to the midpoint of the first shaft and a tip end extended angularly downwards away from the bench. A second tensioning arm is included and has a horizontal elongated rigid second shaft pivotally coupled to the bench between the rear pair of legs, a pair of rigid exterior tongues each having a base end coupled to a separate end of the second shaft and a tip end extended angularly upwards away from the bench, a rigid interior upper tongue having a base end coupled to the midpoint of the second shaft and a tip end extended angularly upwards away from the bench, and a rigid interior lower tongue having a base end coupled to the midpoint of the second shaft and a tip end extended angularly downwards below the bench. A third tensioning arm is included and has a horizontal elongated rigid third shaft pivotally coupled to the bench between the front pair of legs at a location offset below the first tensioning arm, a pair of rigid exterior tongues each having a base end coupled to a separate end of the third shaft and a tip end extended angularly downwards towards the bench, and a pair of interior tongues each having a base end coupled to the third shaft at a location such that they are positioned on either side of the interior tongue of the first tensioning arm and each interior tongue having a tip end extended upwards from the base end away from the bench. A first rod, a second rod, and a third rod are included with the first rod interconnected between the tip end of the interior tongue of the first tensioning arm and the tip end of the interior lower tongue of the second tensioning arm, the second rod interconnected between the tip end of an exterior tongue of the second tensioning arm and the tip end of an exterior tongue of the third tensioning arm, and the third rod interconnected between the tip end of the other exterior tongue of the second tensioning arm and the tip end of the other exterior tongue of the third tensioning arm. A plurality of rigid annular weights are included with each weight slidably positionable upon a separate end of the weight bar of the first tensioning arm. A pair of rigid collars is included with each collar slidable about and securable to a separate end of the weight bar of the first tensioning arm for holding weights securely thereupon. A flexible upper belt is included and has a central harness portion secured to the tip ends of the interior tongues of the first tensioning arm with a pair of chains and opposed straps extended outwards therefrom and securable with a hook and loop fastener in a closed loop configuration about a torso of a user laying upon the bench. Lastly, a flexible lower belt is included and has a central harness portion secured to the tip end of the interior upper tongue of the second tensioning arm with a chain and opposed straps extended therefrom and securable with a hook and loop fastener in a closed loop configuration about a waist of a user laying upon the bench. When a user lays upon the bench and secures the upper belt about his torso and the lower belt about his waist and then pulls downward on the weight bar of the first tensioning arm, the second tensioning arm and the third tensioning arm are actuated to thereby pull the upper belt towards the front edge of the bench and lower belt towards the rear edge of the bench, thus creating controlled tension for extending the user's spine for alleviating back pain.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spinal traction device which has all the advantages of the prior art traction devices and none of the disadvantages.

It is another object of the present invention to provide a new and improved spinal traction device which may be easily and efficiently manufactured and marketed.

It is a further object of the present invention to provide a new and improved spinal traction device which is of durable and reliable construction.

An even further object of the present invention is to provide a new and improved spinal traction device which is susceptible of a low cost of manufacture with regard to both materials and labor, and which accordingly is then susceptible of low prices of sale to the consuming public, thereby making such a spinal traction device economically available to the buying public.

Still yet another object of the present invention is to provide a new and improved spinal traction device which provides in the apparatuses and methods of the prior art some of the advantages thereof, while simultaneously overcoming some of the disadvantages normally associated therewith.

Even still another object of the present invention is to provide a new and improved spinal traction device for allowing a user to stretch his spine using controlled tension for alleviating pain in pinched spinal nerves.

Lastly, it is an object of the present invention to provide a new and improved spinal traction device comprising a rigid elongated elevated bench adapted for supporting a user laying thereupon; an elongated and extended first tensioning arm having a base end, a tip end, and a location therebetween pivotally coupled to the bench at one end thereof with the tip end extending upwards above the bench and with the base end extended downwards an elongated and extended second tensioning arm having base end, a tip end, and a location therebetween pivotally coupled to the bench at the end opposite the first tensioning arm with the tip end extending upwards and with the base end extended downwards; an elongated and extended third tensioning arm having a base end, a tip end, and a location therebetween pivotally coupled to the bench below the first tensioning arm with tip end extended upwards and with the base end extended downwards; rod means secured between the base end of the first tensioning arm and the base end of the second tensioning arm and further secured between the tip end of the second tensioning arm and the base end of the third tensioning arm; an upper belt having a harness portion secured to the tip end of the first tensioning arm and opposed straps extended outwards therefrom and securable about a torso of a user laying upon the bench; and a lower belt having a harness portion secured to the tip end of the second tensioning arm and opposed straps extended therefrom and securable about a waist of a user laying upon the bench; whereby when a user lays upon the bench and secures the upper belt about his torso and the lower belt about his waist and then pulls downward on the tip end of the first tensioning arm, the second tensioning arm and the third tensioning arm are actuated to thereby pull the upper belt and lower belt apart and thus extend the user's spine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGS.

DESCRIPTION OF THE PREFERRED EMBODIMENT

Figure 1:
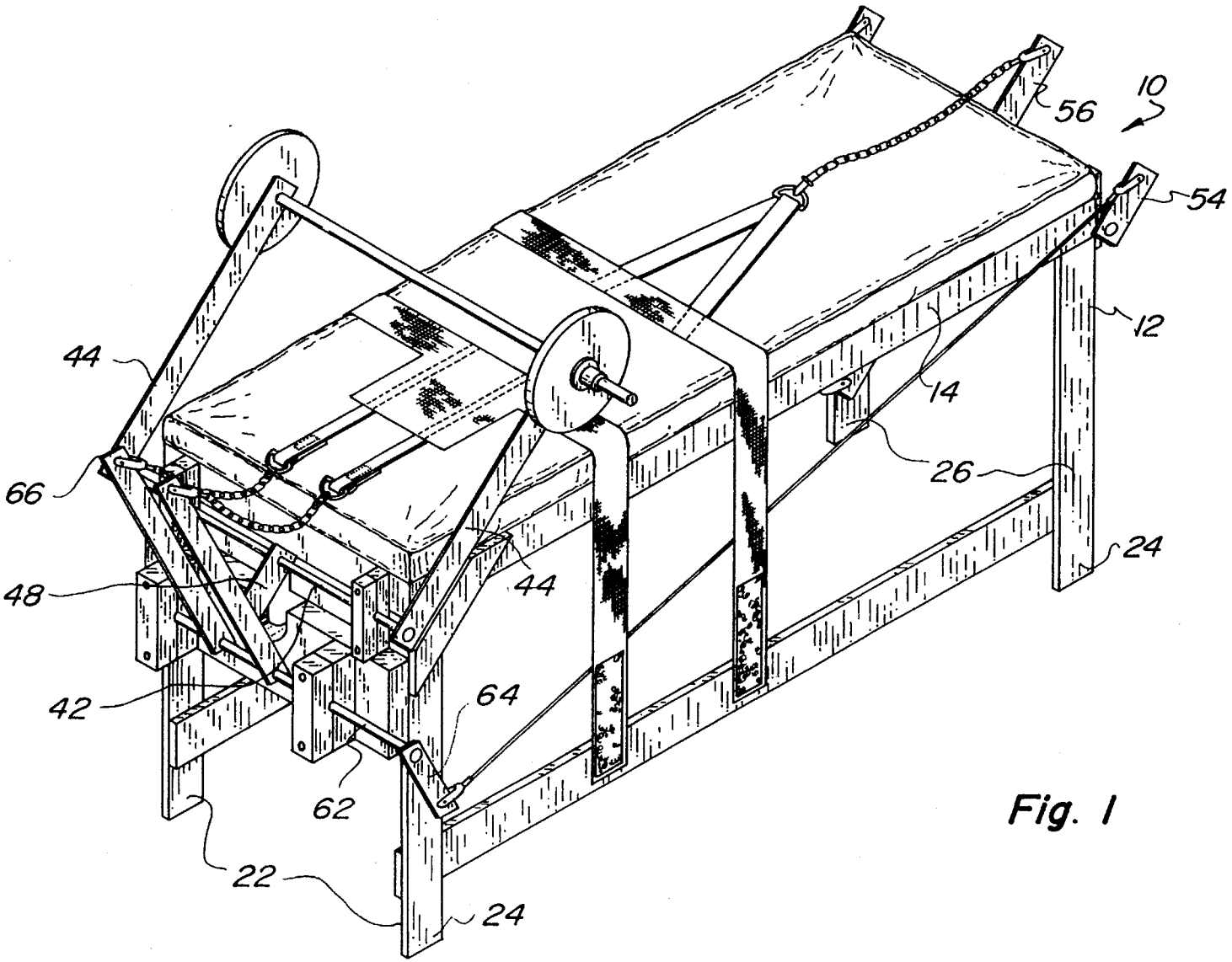
FIG. 1 is a perspective view of the preferred embodiment of the spinal traction device constructed in accordance with the principles of the present invention.
Figure 2:
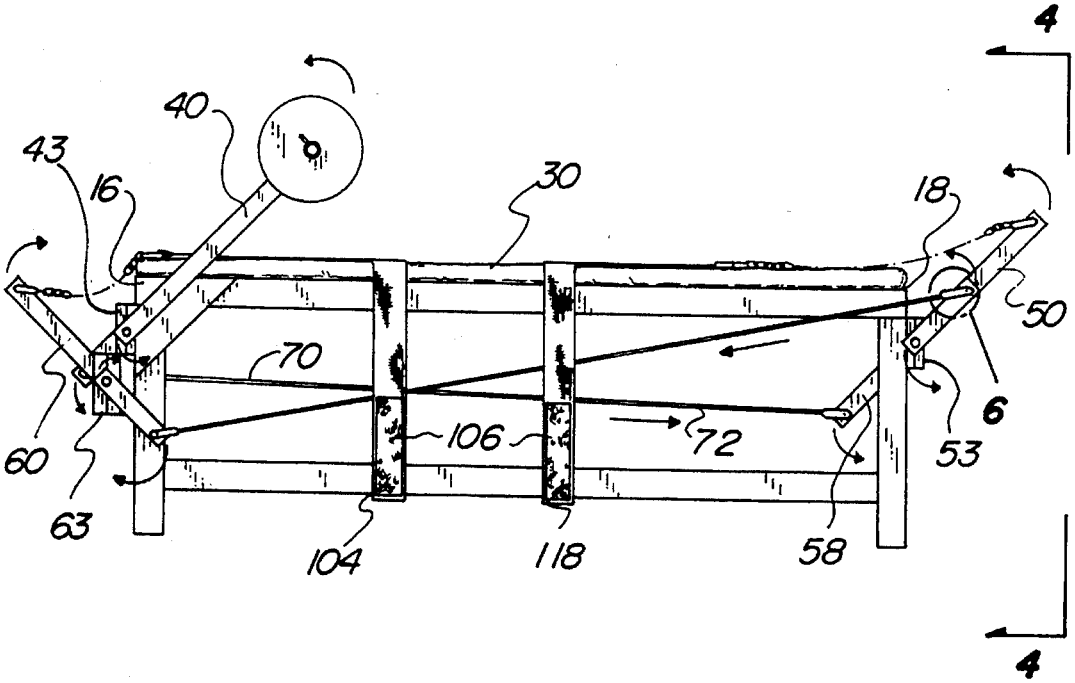
FIG. 2 is a side elevational view of the present invention.
Figure 3:
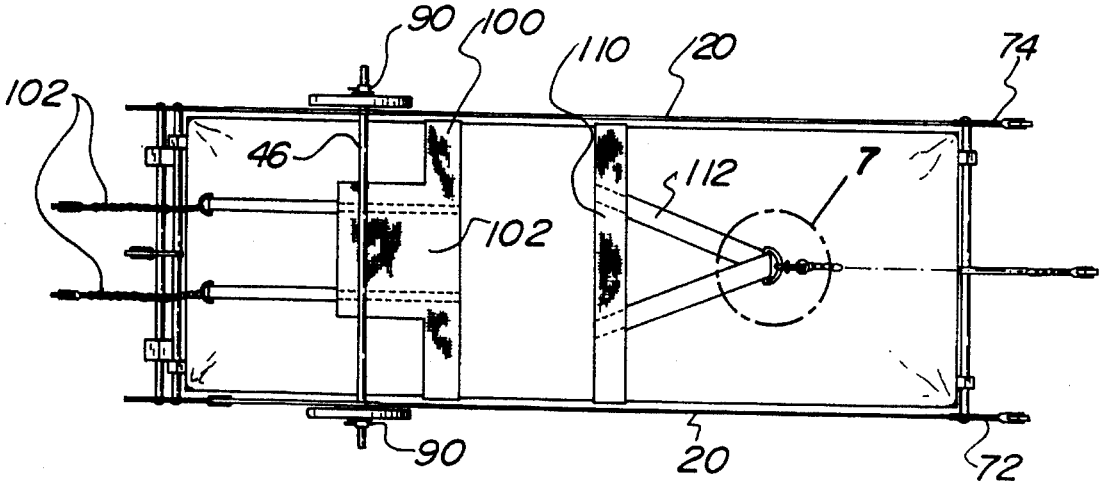
FIG. 3 is a plan view of the present invention depicting direction of motion of the major components when in operation.
Figure 5:
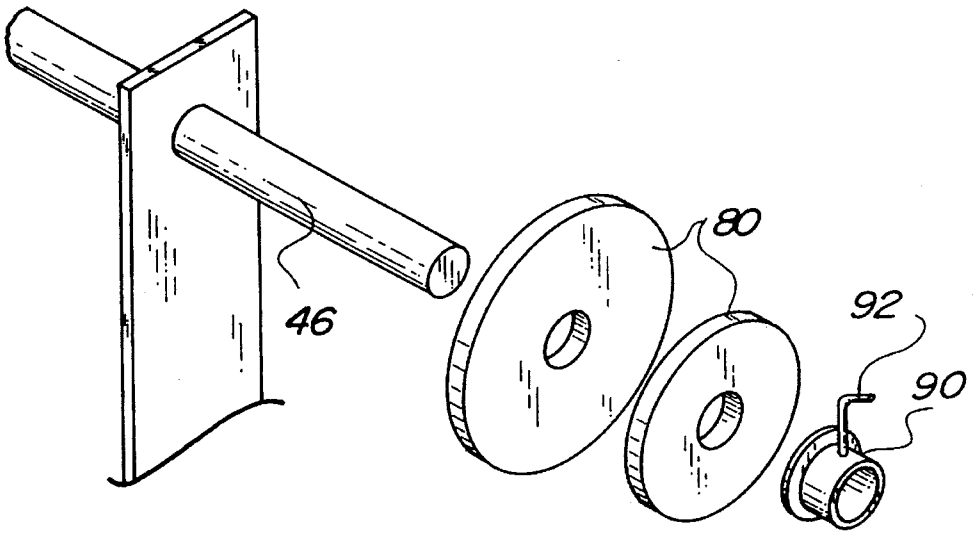
FIG. 5 is an exploded perspective view of the coupling between the removable weights, removable collar, and the weight bar of the first tensioning arm.
Figure 4:
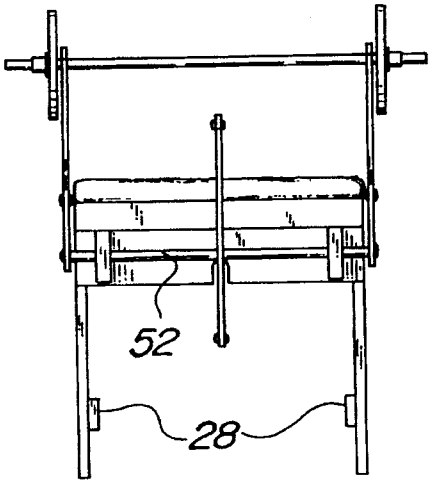
FIG. 4 is yet another side elevational view of the present invention taken along the line 4—4 of FIG. 2.
Figure 6:
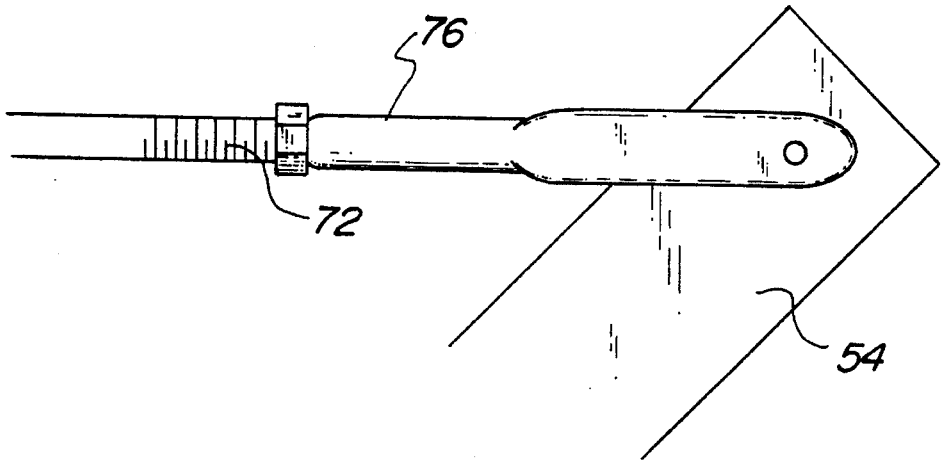
FIG. 6 is an enlarged side elevational view of the adjustable coupling between a rod and an exterior tongue of the second tensioning arm as shown in FIG. 2.
Figure 7:
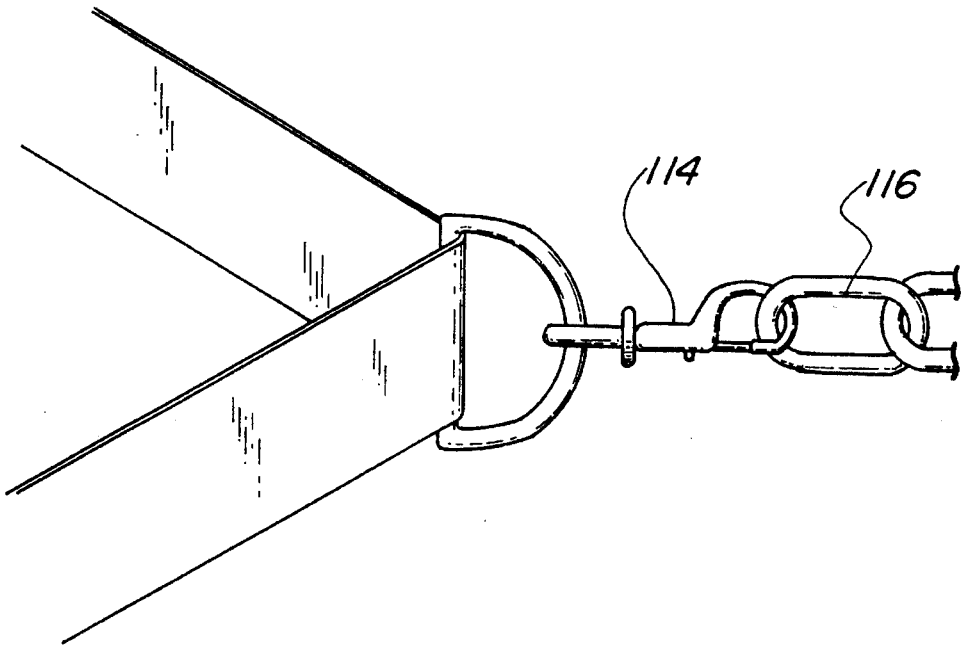
FIG. 7 is an enlarged plan view of the adjustable coupling of the lower harness as shown in FIG. 3.

With reference now to the drawings, and in particular, to FIG. 1 thereof, the preferred embodiment of the new and improved spinal traction device embodying the principles and concepts of the present invention and generally designated by the reference number 10 will be described.

Specifically, the present invention essentially includes nine major components. The major components are the bench, first tensioning arm, second tensioning arm, third tensioning arm, rods, weights, collars, upper belt, and lower belt. These components are interrelated to provide the intended function.

More specifically, it will be noted in the various Figures that the first major component is the bench 12. The bench formed of wood, metal, or other rigid material or combination thereof. The bench is adapted for supporting a user laying thereupon. The bench has a essentially rectangular planar top 14 with a periphery formed of a short front edge 16, a short rear edge 18, and two opposed long side edges 20. The bench includes a front pair of legs 22 with each leg coupled to a separate corner of the top near the front edge and extended downwards therefrom to terminate at a free end 24. The bench also includes a rear pair of legs 26 with each leg coupled to a separate corner of the top near the rear edge and extended downwards therefrom to terminate at a free end 24. The bench includes two opposed, elongated, and horizontally and planarly aligned cross-legs 28. Each cross-leg is coupled between a separate front leg and separate rear leg at a location offset upwards from the free ends thereof. The cross-legs provide the bench added rigidity and stability for supporting a user. The bench also includes a rectangular mattress pad 30 secured upon the top. The mattress pad is adapted for supporting and cushioning a user laying upon the bench.

The second major component is the first tensioning arm 40. The first tensioning arm is made of wood, metal, or other rigid material or combination thereof. The first tensioning arm has a horizontal and elongated first shaft 42 pivotally coupled to the bench between the front pair of legs 22 through use of a bearing block 43. The first shaft is cylindrical in structure. The first tensioning arm also includes a pair of exterior tongues 44. Each exterior tongue has a base end coupled to a separate end of the first shaft and a tip end extended angularly upwards toward the bench to terminate at a location above the mattress pad 30. The tip end is projected at a location such that a user may position his torso thereunder. The first tensioning arm also includes a horizontal and elongated weight bar 46 coupled to the tip ends of the exterior tongues and extended outwards therefrom. The weight bar is cylindrical in structure and made of metal. The first tensioning arm includes an interior tongue 48. The interior tongue has a base end coupled to the midpoint of the first shaft and a tip end extended angularly downwards away from the bench. The exterior tongues and interior tongue of the first tensioning arm are aligned in a common plane.

The third major component is the second tensioning arm 50. The second tensioning arm is made of wood, metal, or other rigid material, or combination thereof. The second tensioning arm has a horizontal and elongated second shaft 52 pivotally coupled to the bench between the rear pair of legs 26 through use of a bearing block 53. The second shaft is cylindrical in structure. The second tensioning arm includes a pair of exterior tongues 54. Each exterior tongue has a base end coupled to a separate end of the second shaft and a tip end extended angularly upwards away from the bench. The second tensioning arm includes an interior upper tongue 56 having a base end coupled to the midpoint of the second shaft and a tip end extended angularly upwards away from the bench and terminated at a location above the mattress pad. The length of the interior upper tongue is longer than the length of the exterior tongues. The second tensioning arm also includes an interior lower tongue 58. The interior lower tongue has a base end coupled to the midpoint of the second shaft and a tip end extended angularly downwards below the bench. The exterior tongues, interior upper tongue, and interior lower tongue are aligned in a common plane.

The fourth major component is the third tensioning arm 60. The third tensioning arm is made of wood, metal, or other rigid material or combination thereof. The third tensioning arm has a horizontal and elongated third shaft 62. The third shaft is cylindrical in structure. The third shaft is pivotally coupled to the bench between the front pair of legs 22 at a location offset below the first tensioning arm 40 through use of a bearing block 63. The third tensioning arm includes a pair of rigid exterior tongues 64. Each exterior tongue has a base end coupled to a separate end of a third shaft and a tip end extended angularly downwards towards the bench. The third tensioning arm includes a pair of interior tongues 66. Each interior tongue has a base end coupled to the third shaft at a location such that they are positioned on either side of the interior tongue 48 of the first tensioning arm. Each interior tongue of the third tensioning arm has a tip end extended upwards from the base end away from the bench. The exterior tongues and interior tongue of the third tensioning arm are aligned in a common plane.

The fifth major component is the rods. The present invention includes a first rod 70, a second rod 72, and a third rod 74. The rods are rigid and made of metal. The first rod is interconnected between the tip end of the interior tongue 48 of the first tensioning arm and the tip end of the interior lower tongue 58 of the second tensioning arm. The second rod is interconnected between the tip end of the exterior tongue 54 of the second tensioning arm and the tip end of the exterior tongue 64 of the third tensioning arm. The third rod is interconnected between the tip end of the other exterior tongue 54 of the second tensioning arm and the tip end of the other exterior tongue 64 of the third tensioning arm. The second rod and third rod are essentially contained in a common plane extended between the first tensioning arm and second tensioning arm. The interconnection of the rods with the tongues is performed with an adjustable yoke end 76. The adjustable yoke end allows the tension of a rod to be adjusted. Each adjustable yoke end is threadably secured to an end of a rod. Each adjustable yoke end is conventional in structure and commercially available in sizes to accommodate the rods.

The sixth major component is the weights 80. The present invention includes a plurality of rigid annular weights. Each weight is slidably positionable upon a separate end of the weight bar 46 of the first tensioning arm. The weights allow the downward force on the weight bar to be adjusted. The force directed upon the first tensioning arm may be increased through the addition of weights.

The seventh major component is the collars 90. The present invention includes a pair of rigid collars. The collars are made of metal or other similar rigid material. Each collar is slidable about and securable to a separate end of the weight bar of the first tensioning arm. Each collar is secured through the use of an L-shaped and threaded bolt 92 extended through the collar to contact the weight bar. The collars securely hold the weights upon the weight bar and thus prevent their inadvertent slippage.

The eighth major component is the upper belt 100. The upper belt is flexible and formed of cloth or similar material. The upper belt has a central harness portion 102. Two straps are extended from the harness portion and secured to the tip ends of the interior tongues 66 of the first tensioning arm with a pair of removable chains 103. The upper belt also includes opposed straps 104 integral to the harness portion and extended outwards therefrom. The opposed straps are securable with a hook and loop fastener 106 in a closed loop configuration about the torso of a user when a user lays upon the bench with his head facing the first tensioning arm. Both the upper belt and lower belt are conventional in design and similar to those used in hospital therapy.

The ninth major component is the lower belt 110. The lower belt is flexible in structure and formed of cloth or similar material. The lower belt has a central harness portion having a v-shaped strap 112 extended therefrom and secured to the tip end of the interior tongue of the second tensioning arm 50 with a securable snap swivel 114 and a chain 116. The lower belt also includes opposed straps 118 integral to the harness portion and extended outwards therefrom. The straps are securable with a hook and loop fastener 106 in a closed loop configuration about a waist of a user laying upon the bench with his feet facing the second tensioning arm.

When a user lays upon the bench and secures the upper belt about his torso and the lower belt about his waist and then pulls downwards on the weight bar of the first tensioning arm, the second tensioning arm and the third tensioning arm are actuated to thereby pull the upper belt towards the front edge of the bench and the lower belt towards the rear edge of the bench. By pulling the belts apart, a controlled tension is created by a user for extending the his spine for alleviating pain in his back. Furthermore, a user may couple weights to the weight bar for increasing the degree of controlled tension.

The present invention stretches the spine of people with pinched nerves in their backs. It enables them to control the amount of tension and the time it is applied without requiring help from another person. This device uses a raised bench with an attached spinal tensioning device. The bench is about 20 inches in width, 78 inches in length, and 30 inches in height with a covered pad and pillow on it. Two wide fabric belts wrap around the patient and fasten together with hook and loop material. The belts have straps at their centers that attach to chains connecting to tensioning arms at the bench ends. The tensioning arms are connected by mechanical linkages to a weight bar that pivots over the user's head. As the weight bar is pulled down, it pulls the tensioning arm at the foot, which in turn pulls two tensioning arms at the head. The weight bar extends outwards to permit weights to be placed on it.

A user lies on the bench and fastens the belts around his torso, one under the arms and the other above the hips. He then reaches up and pulls down on the weight bar above his head, pulling the belts apart. The amount of tension exerted is directly proportional to the force applied to the weight bar. Weights can be placed on the ends of the bar coupled to reduce or eliminate the manual force that must be supplied by the patient. The present invention can also be used without the weights placed on the weight bar.

The present invention can be used at home without additional assistance being provided. The belts move in opposite directions to prevent sliding. The rods in combination with the tensioning arms creates a linkage. The linkage is designed with a mechanical advantage so that the power of a patients pull is multiplied to give greater traction. The advantage of the present invention is that the patient has complete control of the amount of traction received.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A spinal traction device for allowing a user to stretch his spine using controlled tension for alleviating pain in pinched spinal nerves comprising, in combination:

a rigid bench adapted for supporting a user laying thereupon, the bench having a rectangular planar horizontal top with a periphery formed of a short front edge, a short rear edge, and two opposed long side edges, a front pair of legs with each leg coupled to a separate corner of the top near the front edge and extended downwards therefrom to terminate at a free end, a rear pair of legs with each leg coupled to a separate corner of the top near the rear edge and extended downwards therefrom to terminate at a free end, two opposed elongated horizontally aligned cross legs each coupled between a separate front leg and a separate rear leg at a location offset upwards from the free ends thereof, and a rectangular mattress pad secured upon the top;

a first tensioning arm having a horizontal elongated rigid first shaft pivotally coupled to the bench between the front pair of legs, a pair of rigid exterior tongues with each exterior tongue having a base end coupled to a separate end of the first shaft and a tip end extended angularly upwards toward the bench to a location above the mattress pad, a horizontal elongated rigid weight bar coupled to the tip ends of the exterior tongues and extended outwards therefrom, and a rigid interior tongue having a base end coupled to the midpoint of the first shaft and a tip end extended angularly downwards away from the bench;

a second tensioning arm having a horizontal elongated rigid second shaft pivotally coupled to the bench between the rear pair of legs, a pair of rigid exterior tongues each having a base end coupled to a separate end of the second shaft and a tip end extended angularly upwards away from the bench, a rigid interior upper tongue having a base end coupled to the midpoint of the second shaft and a tip end extended angularly upwards away from the bench, and a rigid interior lower tongue having a base end coupled to the midpoint of the second shaft and a tip end extended angularly downwards below the bench;

a third tensioning arm having a horizontal elongated rigid third shaft pivotally coupled to the bench between the front pair of legs at a location offset below the first tensioning arm, a pair of rigid exterior tongues each having a base end coupled to a separate end of the third shaft and a tip end extended angularly downwards towards the bench, and a pair of interior tongues each having a base end coupled to the third shaft at a location such that they are positioned on either side of the interior tongue of the first tensioning arm and each interior tongue having a tip end extended upwards from the base end away from the bench;

a first rod, a second rod, and a third rod with the first rod interconnected between the tip end of the interior tongue of the first tensioning arm and the tip end of the interior lower tongue of the second tensioning arm, the second rod interconnected between the tip end of an exterior tongue of the second tensioning arm and the tip end of an exterior tongue of the third tensioning arm, and the third rod interconnected between the tip end of the other exterior tongue of the second tensioning arm and the tip end of the other exterior tongue of the third tensioning arm;

a plurality of rigid annular weights, having means for each weight slidably positioning upon a separate end of the weight bar of the first tensioning arm;

a pair of rigid collars, each collar having means for sliding about and securing to a separate end of the weight bar of the first tensioning arm for holding weights securely thereupon;

a flexible upper belt having a central harness portion secured to the tip ends of the interior tongues of the first tensioning arm with a pair of chains and opposed straps extended outwards therefrom and securable with a hook and loop fastener in a closed loop configuration about a torso of a user laying upon the bench; and a flexible lower belt having a central harness portion secured to the tip end of the interior upper tongue of the second tensioning arm with a chain and opposed straps extended therefrom and securable with a hook and loop fastener in a closed loop configuration about a waist of a user laying upon the bench;

whereby when a user lays upon the bench and secures the upper belt about his torso and the lower belt about his waist and then pulls downward on the weight bar of the first tensioning arm, the second tensioning arm and the third tensioning arm are actuated to thereby pull the upper belt towards the front edge of the bench and lower belt towards the rear edge of the bench, thus creating controlled tension for extending the user's spine.

2. A spinal traction device comprising:

a rigid elongated elevated bench adapted for supporting a user laying thereupon;

an elongated and extended first tensioning arm means having a base end, a tip end, and a location therebetween pivotally coupled to the bench at one end thereof with the tip end extending upwards above the bench and with the base end extended downwards;

an elongated and extended second tensioning arm means having base end, a tip end, and a location therebetween pivotally coupled to the bench at the end opposite the first tensioning arm means with the tip end extending upwards and with the base end extended downwards;

an elongated and extended third tensioning arm having a base end, a tip end, and a location therebetween pivotally coupled to the bench below the first tensioning arm with tip end extended upwards and with the base end extended downwards rod means secured between the base end of the first tensioning arm and the base end of the second tensioning arm and further secured between the tip end of the second tensioning arm and the base end of the third tensioning arm;

an upper belt having a harness portion with means for securing to the tip end of the third tensioning arm and opposed straps with a pair of free ends extended outwards therefrom, the straps having means for securing about a torso of a user laying upon the bench; and a lower belt having a harness portion with means for securing to the tip end of the second tensioning arm and opposed straps with a pair of free end extended therefrom, and straps having means for securing about a waist of a user laying upon the bench;

whereby when a user lays upon the bench and secures the upper belt about his torso and the lower belt about his waist and then pulls downward on the tip end of the first tensioning arm, the second tensioning arm and the third tensioning arm are actuated to thereby pull the upper belt and lower belt apart and thus extend the user's spine.

3. The spinal traction device as set forth in claim 2 further including a pad having means for recurring upon the bench.

4. The spinal traction device as set forth in claim 2 further including a plurality of weights with the weights having means for coupling to the first tensioning arm.

5. The spinal traction device as set forth in claim 2 wherein the means of the straps of the belt and the means of the straps of the lower belt compose hook and loop fasteners attached to the free ends thereof.

* * * * *